United States Patent [19]

Martin

[11] 4,096,730

[45] Jun. 27, 1978

[54] FORGING PRESS AND METHOD

[75] Inventor: Wayne A. Martin, Wilkins Township, Allegheny County, Pa.

[73] Assignee: United States Steel Corporation, Pittsburgh, Pa.

[21] Appl. No.: 701,934

[22] Filed: Jul. 1, 1976

[51] Int. Cl.[2] ..... B21D 22/00

[52] U.S. Cl. ..... 72/352; 72/377; 72/470

[58] Field of Search ..... 72/352, 357, 470, 377, 72/448, 418; 83/698; 100/242, 295

[56] References Cited

U.S. PATENT DOCUMENTS

| | | | |
|---|---|---|---|
| 3,225,686 | 12/1965 | Clements | 100/295 X |
| 3,638,471 | 2/1972 | Martin | 72/377 |

*Primary Examiner*—Leon Gilden
*Attorney, Agent, or Firm*—Walter P. Wood

[57] ABSTRACT

A forging press and method of forging to enable workpieces of exceptionally large diameter to be forged. The invention is an improvement over a press and method disclosed in an earlier patent in which a rectangular set of top dies is used with a circular set of bottom dies, and the bottom dies are indexed through a pattern of arcs to move a workpiece successively to positions in which it is forged throughout its area. The present invention utilizes a set of bottom dies which is of larger diameter than that of the indexing means and has overhanging edge portions. These portions are additionally supported at diametrically opposed locations where the force of the top dies is absorbed.

4 Claims, 2 Drawing Figures

FORGING PRESS AND METHOD

Figure 1:
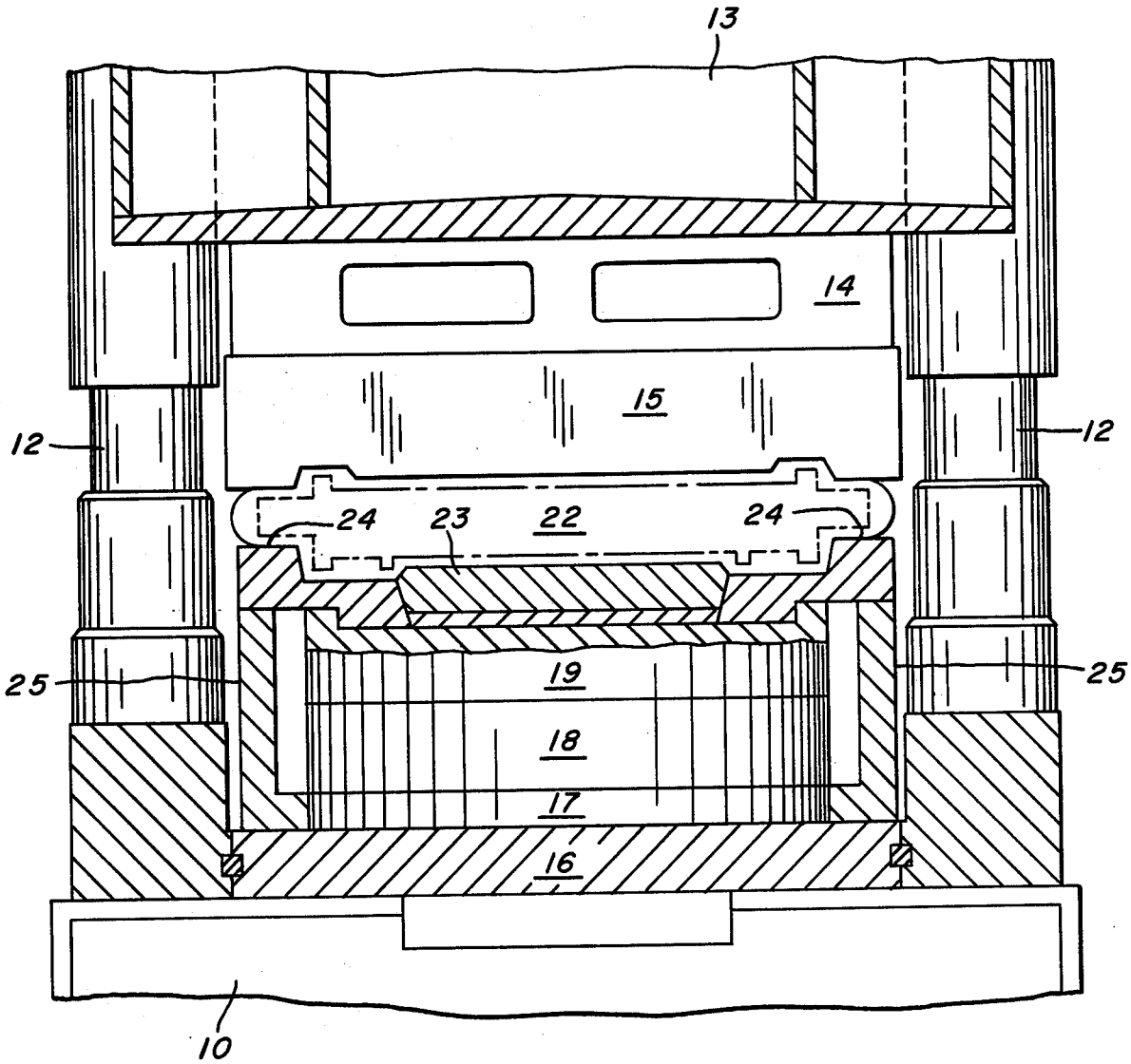

This invention relates to an improved press for forging large shapes and to an improved forging method.

The invention is an improvement over the forging press and method disclosed and claimed in my earlier U.S. Pat. No. 3,638,471 of common ownership, the disclosure of which is incorporated herein by reference. The press disclosed in my earlier patent includes a top die holder which is rectangular in plan and a cooperating bottom die holder which is circular in plan. The top die holder is relatively narrow in width and its longitudinal center line lies directly over the diameter of the bottom die holder when the parts are positioned for forging a workpiece. The bottom die holder is mounted on an indexing table which enables it to be rotated about a vertical axis. The two die holders carry appropriate sets of dies for shaping a workpiece to the desired contours. In operation, a previously heated workpiece is supported on the bottom dies while the top dies are brought down repeatedly against it. The indexing table rotates the bottom die holder, dies and workpiece through a pattern of arcs between operations of the top dies. With repeated indexing, the workpiece is shaped throughout its area.

The press and method disclosed in the patent afford an important advantage in that they enable larger and heavier shapes to be forged on smaller capacity presses than were required previously. Nevertheless the maximum diameter of the final shape which can be forged heretofore has been limited by the diameter of the indexing table. In one example, the press disclosed in the patent is used for forging turbine bucket wheels of a diameter up to about 140 inches, but this is the maximum. Sometimes there is a need for forging even larger diameter shapes, for example, tube plates for nuclear reactor vessels, the diameter of which is about 180 inches. Previous practice in forging shapes of a diameter too large for the press has been to press them between two rectangular flat plates and then machine them to the desired configuration. The excessive machining required makes this practice unduly costly. Another disadvantage of this practice is that the flow lines in the finished shape are flat, rather than following the contours of the shape. This results in a less desirable metallurgical structure.

An object of the present invention is to provide means for and a method of adapting the forging press disclosed in my earlier patent so that it may be used to forge shapes of diameter larger than that of the indexing table.

A more specific object is to provide an improved press and method for accomplishing the foregoing object in which I employ a set of bottom dies of diameter larger than that of the indexing table and special posts for supporting the overhanging edge portions of these bottom dies.

A further object is to improve the metallurgical properties of forged shapes, compared with shapes pressed between flat plates, by producing shapes in which the flow lines follow the contours of the shape.

Figure 2:
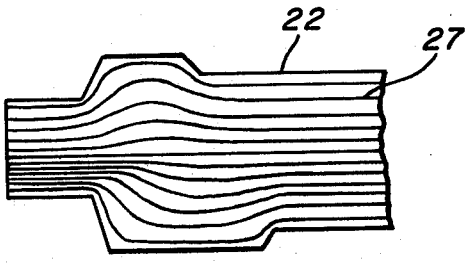

In the drawing:

FIG. 1 is a partially diagrammatic vertical sectional view of a forging press embodying the present invention; and FIG. 2 is a fragmentary diagrammatic view of a forged workpiece illustrating the flow lines.

FIG. 1 shows a portion of a forging press constructed in accordance with the disclosure of my aforementioned patent. The press rests on a foundation 10 and it comprises columns 12 upstanding from the foundation and a crosshead 13 guided for vertical movement on the columns. The crosshead carries a false plate 14 fixed to its underside, and a set of top dies 15 fixed to the false plate. A bolster plate 16 rests on the foundation 10 and supports a stationary base plate 17, a stationary table 18, and a rotatable indexing table 19. Since the foregoing parts and their operations are similar to corresponding parts disclosed in the patent, they need not be disclosed in detail here.

In accordance with the present invention, when a workpiece 22 is to be forged to a diameter larger than that of the indexing table 19, I install on the indexing table a set of bottom dies 23 likewise of larger diameter than that of the indexing table. These dies have an annular edge portion 24 which overhangs the indexing table around its full circumference. I insert a pair of diametrically opposed removable supporting posts 25 between the bolster plate 16 and the overhanging portion 24. The posts are located directly under the extreme outer portions of the top dies 15. It is not necessary to provide additional support for the overhanging portions of the bottom dies except at the areas which absorb the force applied through the top dies. Hence I need use only the two posts illustrated.

In operation, the workpiece 22 is supported on the bottom dies 23. FIG. 1 shows the workpiece after forging, when it has a diameter larger than that of the indexing table 19. To forge the workpiece to this diameter, the rectangular top dies 15 are brought down repeatedly against the workpiece. Between operations of the top dies the indexing table 19 is rotated through a pattern of arcs to move the workpiece successively to positions in which it can be forged throughout its area, as explained in my aforementioned patent. As also explained in the patent, when the indexing table rotates, it is lifted slightly from the stationary table 18 to avoid frictional contact. Thus it is also lifted slightly clear of the posts 25 which do not interfere with rotation.

FIG. 2 shows diagrammatically the flow lines 27 in the workpiece after forging. These lines follow the contour of the workpiece, rather than lying flat as in a workpiece pressed between flat plates. Thus the invention improves the metallurgical properties of the forged shape as compared with a shape pressed between flat plates.

From the foregoing description it is seen that the present invention affords a simple construction and apparatus for adapting the press and method disclosed in my earlier patent to forge still larger shapes. The invention makes it possible to avoid the excessive machining needed when oversize shapes are pressed between flat plates as well as improving the metallurgical properties. FIG. 1 also shows in dot-dash lines the cross-sectional outline of the workpiece after it has been machined. The diameter of the machined workpiece may remain larger than the diameter of the indexing table, as illustrated.

I claim:

1. In a forging press which includes cooperating sets of top and bottom dies, and an indexing table supporting said set of bottom dies for rotation on a vertical axis, said set of top dies being rectangular in plan and supported for vertical movement, said set of bottom dies being circular in plan, whereby indexing said set of bottom dies through a pattern of arcs moves a workpiece supported thereon successively to positions in which it can be forged throughout its area between said dies, the improvement in which the diameter of said set of bottom dies in larger than the diameter of said indexing table and has edge portions which overhang the table, and comprising a pair of removable diametrically opposed posts outside said table under said set of top dies providing support for said edge portions in the regions which absorb force applied through said set of top dies during a forging operation.

2. An improvement as defined in claim 1 in which said press includes a bolster plate on which said indexing plate is supported, and said posts are inserted between said edge portions and said bolster plate.

3. In a forging operation in which a workpiece is pressed between cooperating top and bottom dies, said top die being rectangular in plan, said bottom die being circular in plan, and said bottom die is indexed through a pattern of arcs to move a workpiece successively to positions in which it is forged throughout its area, an improved method of employing the operation to forge workpieces which have a larger diameter than that of the indexing means, said method comprising installing on the indexing means a set of bottom dies of larger diameter than that of the indexing means and having overhanging edge portions, and additionally supporting said edge portions with removable posts inserted at two diametrically opposed locations where the force applied through said set of top dies is absorbed.

4. A method as defined in claim 3 in which the forged workpiece has flow lines following the contours of the workpiece, thus improving the metallurgical quality as compared with a shape pressed between flat plates.

* * * * *